United States Patent [19]

Garcea

[11] 4,364,338

[45] Dec. 21, 1982

[54] CIRCUIT OF THE COOLANT IN INTERNAL COMBUSTION ENGINES FOR IMPROVING ENGINE OPERATION AFTER COLD STARTING

[75] Inventor: Giampaolo Garcea, Milan, Italy

[73] Assignee: Alfa Romeo S.p.A., Milan, Italy

[21] Appl. No.: 87,383

[22] Filed: Oct. 22, 1979

[30] Foreign Application Priority Data

Oct. 31, 1978 [IT] Italy ..... 29341 A/78

[51] Int. Cl.[3] ..... F01P 7/16

[52] U.S. Cl. ..... 123/41.10; 236/34.5

[58] Field of Search ..... 123/41.02, 41.08, 41.09, 123/41.1; 236/34.5

[56] References Cited

U.S. PATENT DOCUMENTS 2,435,041 1/1948 Hild ..... 123/41.1

3,805,748 4/1974 Garcea et al. ..... 123/41.1

3,851,629 12/1974 Mayr et al. ..... 236/34.5

FOREIGN PATENT DOCUMENTS 52-11344 1/1977 Japan ..... 236/34.5

*Primary Examiner*—Craig R. Feinberg

*Assistant Examiner*—W. R. Wolfe

*Attorney, Agent, or Firm*—Charles A. Brown

[57] ABSTRACT

This invention relates to a coolant circuit for internal combustion engines, specially for motor vehicles. In order to improve the engine operation after cold starting, there is provided a second valve which cooperates with the usual thermostatic valve so as to lower substantially to zero the flow rate of the coolant through the circulating pump and the engine when the engine and the coolant are still cold and limited power is requested.

3 Claims, 5 Drawing Figures

Fig.1
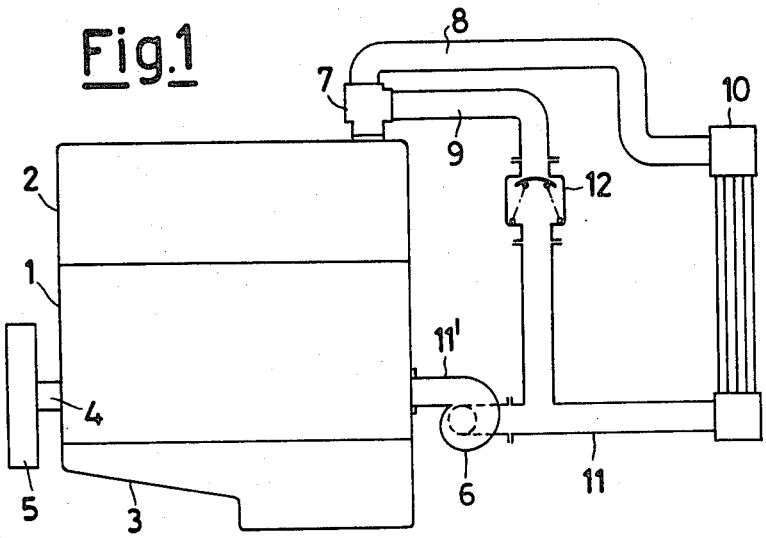
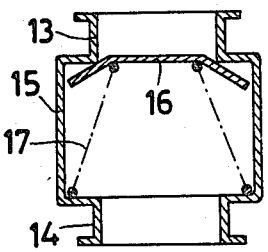
Fig.2
Fig.5
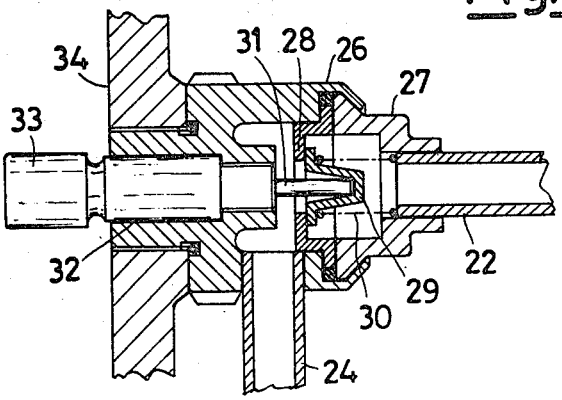

CIRCUIT OF THE COOLANT IN INTERNAL COMBUSTION ENGINES FOR IMPROVING ENGINE OPERATION AFTER COLD STARTING

All internal combustion engines, specially for motor vehicles, if they are cooled by a liquid, are provided with a circulating pump, generally of the "centrifugal'-'kind, connected to the main driving shaft so that its number of revolutions is proporational to the number of revolutions of the main driving shaft. An essential task of that pump is to circulate the coolant in the ducts and in the internal cavities provided for this purpose in the engine in order to avoid the overheating of its various parts, specially of those exposed to the gases of combustion; but equally essential is the task of the pump to circulate in a radiator the coolant in order that the heat accumulated therein while flowing through the engine, be dissipated. Hence the pump is inserted in a circuit to which both the engine and the pump belong: in this circuit there is also inserted a thermoplastic valve, generally a three-way valve, provided in the outlet duct for the coolant leaving the engine, namely usually in the outlet duct of the coolant from the head of the engine. The internal thermoplastic member of the valve displaces the internal movable member of said valve in such a manner that at temperatures of the coolant below a prefixed value the coolant is not sent to the radiator but is short-circuited towards the suction conduit of the pump: in this way the coolant can raise its temperature with sufficient rapidity. When the temperature of the coolant tends to surpass the said prefixed value the thermoplastic member actates the movable member of the valve in such a manner as to reduce the short-circuited delivery of coolant and to send instead the coolant to the radiator. In the extreme case, therefore, when the coolant is cold the delivery of coolant through the radiator is nil, whilst if the coolant is rather warm, the whole delivery of the pump passes through the radiator. Since the hydraulic resistances in passing through the three-way valve (at the various temperatures and, therefore, in the various positions of the internal movable member) and through the radiator are quite modest, the flow of the coolant through the engine, which is also the delivery of the pump, does not change substantially with the varying of the temperature of the coolant, namely of the configuration assumed by the three-way valve. In these conventional circuits therefore in the operation immdiately after starting, while the engine and the coolant are cold, the circulation of the coolant through the engine is the same as when the engine and the coolant are already thermically rated: inthis initial stage of operation, therefore, the coolant removes heat from the parts of the engine that are at contact with the gases of cimbustion (walls of the explosion chamber, cylinder pipes) and that heat is utilized to warm up to the rated temperature the whole of the coolant contained in the engine and also the whole mass of the engine. With a determined engagement of power after starting, it requires a certain time to attain the rated temperature, during which time, since the said parts of the engine, at contact with the gases, are still cold or not warm enough, the combustion of the fuel takes place in a not perfect manner; hence with exhaust of unburnt fuel at the exhaust port; which exhaust is considerable also because while the engine is cold the fuel must be enriched in order that the operation of the engine be regular (a part of the petrol (gasoline) introduced with the fuel adheres to the still cold walls of the ducts and of the cylinder without burning).

It is to shorten the time of heating of the engine parts at contact with the fuel and with the gases of combustion (and to diminish consequently the exhaust of unburnt fuel) that the coolant circuit according to the instant patent application was developed: in which it has been thought of reducing considerably or even of reducing to nil the delivery of coolant through the engine in operation after starting, and this until the temperature of the coolant at contact with the said parts being at contact with the fuel and the gases of combustion attains a certain value: above said value the operation of the circuit becomes again as conventional insofar the delivery of coolant through the engine becomes again as conventional. In this way the thermal rating of said parts, which are those involved with the fact of the combustion, takes place in an interval of time, e.g. reduced by 50%; while obviously the thermal rating on the other parts of the engine (and of the remaining portion of coolant of the circuit), which are not involved with the fact of combustion, is somewhat delayed. During the stage of heating of the said parts of the engine at contact with the gases the said heating of course is controlled by the fact that they are also at contact with the coolant, which, even if the delivery is nil, is animated by motion of convection. It is however thought, and has been also found, that such motion of convection cannot control the regularity of heating if during the thermal rating the engine is engaged at rather high power rates or at very high power rates: so that the self-acting re-activation of the delivery of coolant through the engine is foreseen if the driver, notwithstanding the engine still be cold because just started, engages the engine at a number of revolutions higher than a predetermined value (e.g. 50% as compared with the maximum number of revolutions).

The circuit according to the instant patent application will be more fully understood with reference to the accompanying drawings, wherein:

FIG. 1 shows a general diagrammatical representation of an engine with a cooling circuit according to the invention;

FIG. 2 shows a particular of the circuit of FIG. 1;

FIG. 5 shows a particular of FIG. 4.

Figure 3:
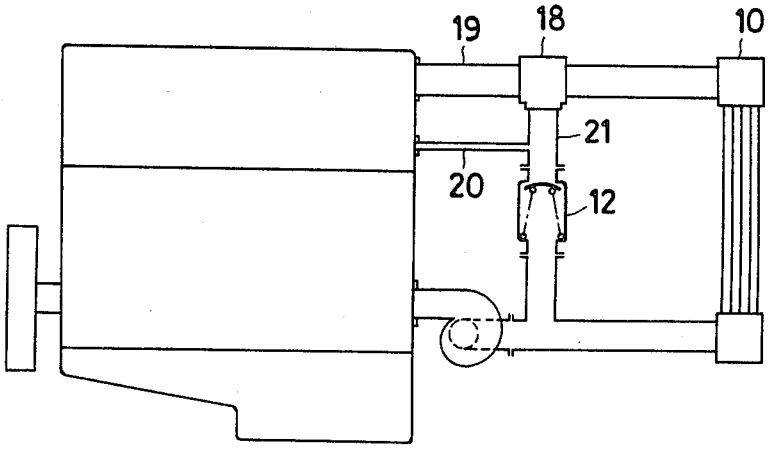
FIGS. 3 and 4 show variants of the diagrammatical representation of FIG. 1.

In FIG. 1 there is above all represented diagrammatically a normal in-line engine, in side view, formed by the crankcase 1, by the head 2, and by the oil sump 3. By the reference numeral 4 is indicated the end outside the crankcase of the crankshaft, by 5 the flywheel, by 6 the centrifugal pump of the coolant, driven by the crankshaft with the aid of means not shown in the drawing, by 11' the delivery conduit connected with the crankcase 1. Further by 7 is indicated the normal thermostatic three-way valve, placed on the head 2 at the outlet conduit for the coolant leaving the head. The two outlet holes of the three-way valve 7 are connected respectively with one end of the conduit 8 and of the conduit 9. The other end of the conduit 8 is connected with the inlet of the radiator 10 whilst the conduit 11 connects the outlet of the radiator 10 with the inlet of the pump 6. The other end of the conduit 9 is connected to the aforesaid conduit 11. The conduit 9 is therefore a conduit provided in parallel in the circuit with respect to the radiator 10; and when, while the coolant is cold, the thermostatic valve 7 is closed towards the conduit 8 and open towards the conduit 9, the latter acts as a short-circuiting conduit with respect to the radiator 10. An essential feature of the circuit according to the instant patent application is the insertion into the conduit 9 of the automatic valve 12, which is also represented separately on larger scale in FIG. 2. In this Figure, the automatic valve is seen in section by a plane passing through its axis, which coincides with the axis of the mouth 13 and of the outlet hole 14; in the interior of the cylindrical body 15 of the valve there can slide axially the movable valve member 16 composed of a central disc provided with radial extensions that center it with respect to the cylindrical body 16 while between one extension and the other, the valve being open, the coolant can pass freely; the preloaded flexible spring 17 keeps the member 16 against the corresponding circular seat on the conduit of mouth 13; the valve therefore is closed and the short-circuit delivery through the conduit 19 of FIG. 1 is nil as long as the lift of the pump 6 is not such as to make the resultant of the pressures on the member 16 surpass the value of the preload of the spring 17. This preload is e.g. determined in such a manner that the valve opens with the lift of the pump during operation of the engine at 50% of the maximum number of revolutions. In that way, while the engine and the coolant are still cold, because the thermostatic valve 7 locks the passage through the conduit 8, the automatic valve 12 being closed if the number of revolutions is less than 50% of the maximum number of revolutions, the delivery through the engine is nil; whilst with higher numbers of revolutions, with the opening of the valve 12, the coolant circulates through the conduit 9 and through the engine. If the engine is already at its normal rate, the flow passing through the engine is that passing through the radiator.

Another version of the circuit according to the instant patent application is represented in FIG. 3 which relates to the case in which the thermostatic three-way valve 18 is not applied directly to the outlet mouth of the chamber of the coolant in the head (as valve 7 in FIG. 1), but is applied to the end of a conduit 19 that is connected to the aforesaid outlet of the chamber of the coolant in the head. It may happen in this case that in the interior of the conduit 19 the convective motion is so modest that when the temperature of the coolant is already the rated temperature in the chamber of the coolant in the head, the temperature of the coolant at the inlet of the thermostatic valve 18 is still modest, whence the valve 18 does not open and, therefore, in the head the coolant becomes overheated. The conduit 20 placed in a position lower than the position of the conduit 19, connecting the section of conduit 21 (intermediate between the valves 18 and 21) with a zone of the head lower than the inlet mouth of the conduit 19, can make active a motion of the coolant by effect of the principle underlying the so-called "central heating", so as to avoid the aforemention inconvenience due to the delay with which at the valve 18 there appear the temperatures of the coolant in the head.

Figure 4:
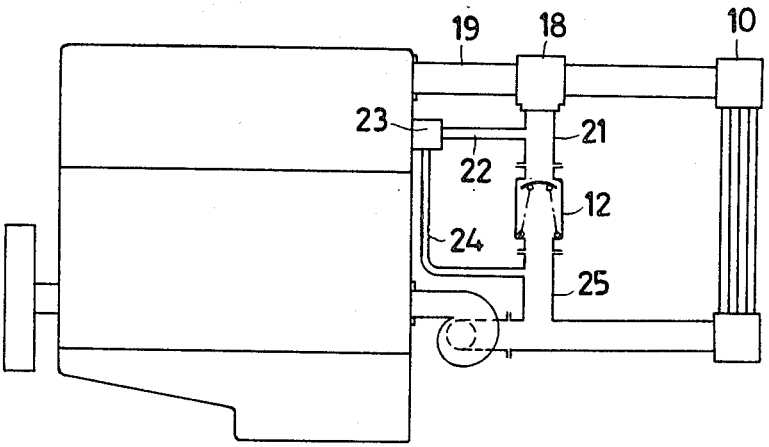

A third version of the circuit is the one foreseen in FIG. 4 for the case in which the said inconvenience of delay cannot be overcome by means of the duct 20 of FIG. 3: for this case the conduit 21 is connected through the small duct 22 with the thermostatic cook (or two-way thermostatic valve) 23 and through the small duct 24 with the conduit 25 downstream the valve 12; when the temperature of the coolant in the head attains a determined value the thermostatic cook 23 being at contact with the said coolant opens; the automatic valve 12 so becomes short-circuited and the liquid of the head arrives at the thermostatic valve 18 which, therefore, can become active without delay. By way of example without limitation a version of the thermostatic cock 23 of FIG. 4 is shown in FIG. 5 in which there are again indicated with 22 and 24 as in FIG. 4 the conduits respectively of entry and outlet and connected with the cock; 26 and 27 are the two parts of which the body of the cock is composed; 28 is an internal wall inside the cock, provided with a hole which when the engine is cold, is occluded by the movable valve member 29 upon which there acts the preloaded spring 30; while the engine is warm, the movable pusher 31 of the thermostatic member 32 (based on wax expansion) acts upon the member 29 so as to open the passage of the coolant through the hole of the wall 28; the member 32, served to the part 26 of the cock body, has its bulb 33, containing the wax, at contact with the coolant contained in the interior of the head, the wall of which is indicated by reference numeral 34.

I claim:

1. A circuit of the coolant of an internal combustion engine, specially for a motor vehicle, said circuit comprising cavities in the interior of said engine to be filled and wiped with said coolant, a radiator for the cooling of said coolant, a circulating pump of the centrifugal type for said coolant, said circulating pump being driven by a main shaft of said engine and having a delivery duct connected with an inlet hole of said engine cavities, a first conduit connected at one end with an outlet hole of said engine cavities and at its other end with said radiator, a thermostratic threeway valve inserted in said first conduit, a second conduit connected at one end with said thermostatic threeway valve, a third conduit between said radiator and said circulating pump, said second conduit being connected at its other end with said third conduit, a second valve having means for closing said second valve automatically in response to limited power engagements of the engine, a fourth conduit of smaller cross-section connected at one end with said engine cavities and at its other end with said second conduit in its portion upstream of said second valve, said fourth conduit providing means for a circulation of said coolant through said thermostatic valve while said engine is still cold.

2. A circuit according to claim 1 wherein said fourth conduit being at a lower height than that portion of said first conduit disposed between said engine cavities and said thermostatic valve.

3. A circuit according to claims 1 or 2, characterized in that there is a third valve in said fourth conduit, said third valve being of the thermostatic type that is closed when said engine and said coolant are cold and is open when a selected temperature of said coolant circulating in said engine internal cavities is surpassed.

* * * * *

UNITED STATES PATENT AND TRADEMARK OFFICE

CERTIFICATE OF CORRECTION

PATENT NO. : 4,364,338

DATED : December 21, 1982

INVENTOR(S) : Giampaolo Garcea

It is certified that error appears in the above-identified patent and that said Letters Patent is hereby corrected as shown below:

Column 1, line 8, -- "centrifugal'- -- should read -- "centrifugal " --.

Column 1, line 9, -- 'kind -- should read -- kind --.

Column 1, line 21, "thermoplastic" should read -- thermostatic --.

Column 1, line 25, "thermoplastic" should read -- thermostatic --.

Column 1, line 33, "thermoplastic" should read -- thermostatic --.

Column 1, line 49, "immdiately" should read -- immediately --.

Column 1, line 52 "inthis" should read -- in this --.

Column 3, line 13, "16" should read -- 15 --.

UNITED STATES PATENT AND TRADEMARK OFFICE

CERTIFICATE OF CORRECTION

PATENT NO. : 4,364,338

DATED : December 21, 1982

INVENTOR(S) : Giampaolo Garcea

It is certified that error appears in the above-identified patent and that said Letters Patent is hereby corrected as shown below:

Column 4, line 1, "cook" should read -- cock --.

Column 4, line 5, "cook" should read -- cock --.

Column 4, line 22, "served" should read -- screwed --.

Signed and Sealed this

*Twelfth* Day of *June 1984*

[SEAL]

*Attest:*

GERALD J. MOSSINGHOFF

*Attesting Officer*

*Commissioner of Patents and Trademarks*